US005326313A

United States Patent [19]

Miniat

[11] Patent Number: 5,326,313

[45] Date of Patent: Jul. 5, 1994

[54] THRUST BEARING ASSEMBLY FOR ROOF TURBINE

[75] Inventor: William R. Miniat, Dallas, Tex.

[73] Assignee: Clark United Corporation, Dallas, Tex.

[21] Appl. No.: 947,741

[22] Filed: Sep. 21, 1992

[51] Int. Cl.[5] ..... F23L 17/02

[52] U.S. Cl. ..... 454/18

[58] Field of Search ..... 454/15, 18, 19; 252/12; 384/281, 282, 283, 300, 301

[56] References Cited

U.S. PATENT DOCUMENTS

| | | | |
|---|---|---|---|
| 257,484 | 5/1882 | Fenn | 454/18 |
| 1,613,666 | 1/1927 | Lighthart . | |
| 2,194,817 | 3/1940 | Boiu | 308/193 |
| 2,690,364 | 11/1952 | Buckwalter | 308/227 |
| 3,267,833 | 8/1966 | Artis et al. | 454/18 |
| 3,392,659 | 7/1968 | Rousey | 454/18 |
| 3,590,720 | 7/1971 | Siegal . | |
| 3,645,192 | 2/1972 | Rousey | 454/18 |
| 3,693,086 | 9/1972 | Redecker et al. | 252/12 X |
| 3,856,686 | 12/1974 | Sato et al. | 252/12 X |
| 4,046,436 | 9/1977 | Brown | 308/233 |
| 4,106,359 | 8/1978 | Wolfe et al. | 74/424.8 R |
| 4,685,172 | 8/1987 | O'Connor | 16/2 |
| 4,831,921 | 5/1989 | Potter . | |
| 4,913,562 | 4/1990 | Rosen | 384/301 |

*Primary Examiner*—Harold Joyce
*Attorney, Agent, or Firm*—Dennis T. Griggs

[57] ABSTRACT

The turbine head of a wind-powered turbine ventilator is rotatably supported on a spindle by a thrust bearing assembly. A thrust receptacle is mounted on the upper part of the turbine head to receive the supporting end of the spindle. A centering collar coupled to the lower end of the spindle limits lateral deflection of the turbine. The thrust bearing components are constructed of complementary materials, acetal resin and polyamide resin, which provide a self-lubricating effect when rubbed together.

4 Claims, 4 Drawing Sheets

THRUST BEARING ASSEMBLY FOR ROOF TURBINE

FIELD OF THE INVENTION

This invention relates to bearing structures, and in particular to a thrust bearing assembly for supporting the vaned head of a wind-powered turbine ventilator.

BACKGROUND OF THE INVENTION

Turbine ventilators are widely used for under-roof ventilation in domestic, commercial and industrial applications. Their popularity stems largely from a relatively modest purchase cost coupled with a substantial absence of any operating cost and ability to operate without regulation. That is, the primary purpose of the turbine ventilator is to exhaust under-roof accumulation of hot air either internally generated or as a result of sun load on the roof. For that purpose, a precise quantity of airflow need not be maintained continuously but can instead be permitted to fluctuate within a wide range.

Being wind-powered, capacity fulfillment of the turbine ventilator to induce a forced airflow upward through a roof opening is dependent upon and will fluctuate extensively in correlation to ambient wind velocity. Continuous exposure to varying wind and rotational forces subjects the ventilator and its bearing supports to severe vibration and wear.

DESCRIPTION OF THE PRIOR ART

Wind-powered turbine ventilators are available in various sizes affording a rated flow capacity at a given wind velocity. Their construction usually includes a vaned head mounted for rotation relative to a stationary base. The base is mountable onto a roof over an opening provided therein in communication with the space to be ventilated. Exterior bracing may be provided to aid in securing the components relative to each other while an internal spindle in cooperation with a roller bearing assembly provides rotary support for the turbine.

It is desirable in such constructions to minimize resistance to rotation since any reduction in rotational velocity at a given wind velocity decreases the ability of the turbine ventilator to perform at its rated capacity. Typically, load-supporting roller bearings are mounted about the lower end of the spindle in conventional turbines to reduce such resistance. Wind loading has in some instances caused the lower spindle bearings to become unseated or loosened. Additionally, airborne dust and water may penetrate into the bearing assembly causing the roller bearings to seize or degrade in performance through an increase in frictional drag. The lowering of the effectiveness of the roller bearings results generally in an increase of frictional drag forces and may eventually cause uneven bearing wear and seizure. Such structural failure frequently results in the entire ventilator unit being discarded and replaced.

Exemplifying bearing assemblies for turbine ventilators of the prior art is the disclosure of U.S. Pat. No. 4,831,921.

OBJECTS OF THE INVENTION

The general object of the invention is to provide an improved wind-actuated turbine ventilator for under-roof ventilation.

A related object of the invention is to provide a bearing assembly for a turbine ventilator having improved operational reliability and a significantly extended operational life expectancy as compared to roller bearing constructions in turbine ventilators of the prior art.

Yet another object of the invention is to provide an improved bearing assembly for a turbine ventilator that can better withstand vibrational and environmental effects.

SUMMARY OF THE INVENTION

The foregoing objects are achieved in accordance with the present invention by a turbine support assembly that is adapted for surface mounting about an aperture through which a ventilating airflow is to be induced. A wind-responsive turbine head is disposed for rotation about an axis through the turbine support assembly. The turbine head is supported for rotation by a thrust bearing on an elongated spindle that is coaxially disposed within the turbine head. The spindle rotatably supports the turbine head on an axial shaft end portion. A thrust bearing receptacle is mounted on the upper part of the turbine head to receive the supporting end of the spindle and rotatably supports the turbine head on the axial shaft portion.

In the preferred embodiment, the thrust bearing receptacle and the supporting end of the spindle are constructed of friction-reducing materials which are complementary with respect to each other for providing a self-lubricating effect when used together. Preferably, the supporting end of the spindle is made of polyamide polymer, for example, ZYTEL nylon resin, and the thrust bearing receptacle is preferably made of acetal resin, for example, DELRIN acetal resin.

The lower portion of the turbine support assembly includes a bushing assembly to maintain centered alignment of the turbine head about the spindle. In the preferred embodiment, the bushing assembly includes a centering collar which is attached to the turbine head and is concentrically centered about the spindle. The centering collar is coupled to the spindle by a rotatable bushing. The centering collar and the rotatable bushing are constructed of friction-reducing materials which are complementary with respect to each other for providing a self-lubricating effect. Preferably, the centering collar is constructed of DELRIN acetal resin, and the rotatable bushing is constructed of ZYTEL polyamide polymer resin.

The above noted features and advantages of the invention as well as other superior aspects thereof will be further appreciated by those skilled in the art upon reading the detailed description which follows with reference to the drawings.

DESCRIPTION OF THE PREFERRED EMBODIMENT

Figure 1:
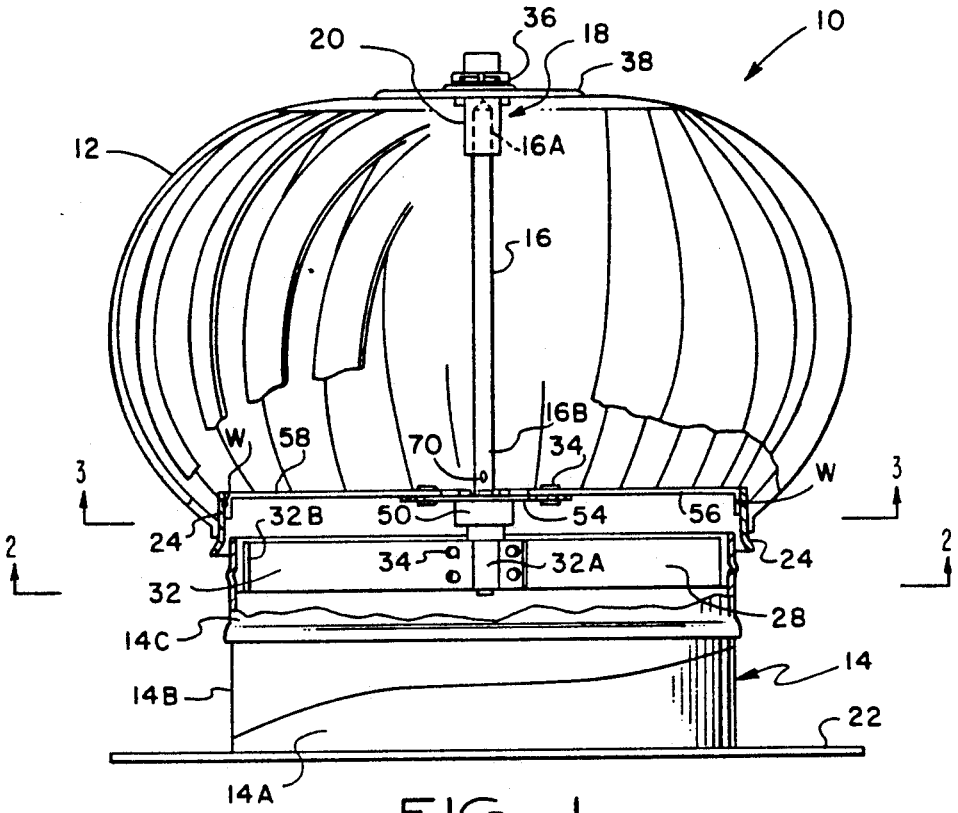
FIG. 1 is an elevational view of a turbine ventilator, partially broken away, having a vaned turbine head mounted on the thrust bearing assembly of the present invention.

In the description which follows, like parts are marked throughout the specification and drawings with the same reference numerals, respectively. The drawing figures are not necessarily to scale and the proportions of certain parts have been exaggerated for purposes of clarity.

Figure 2:
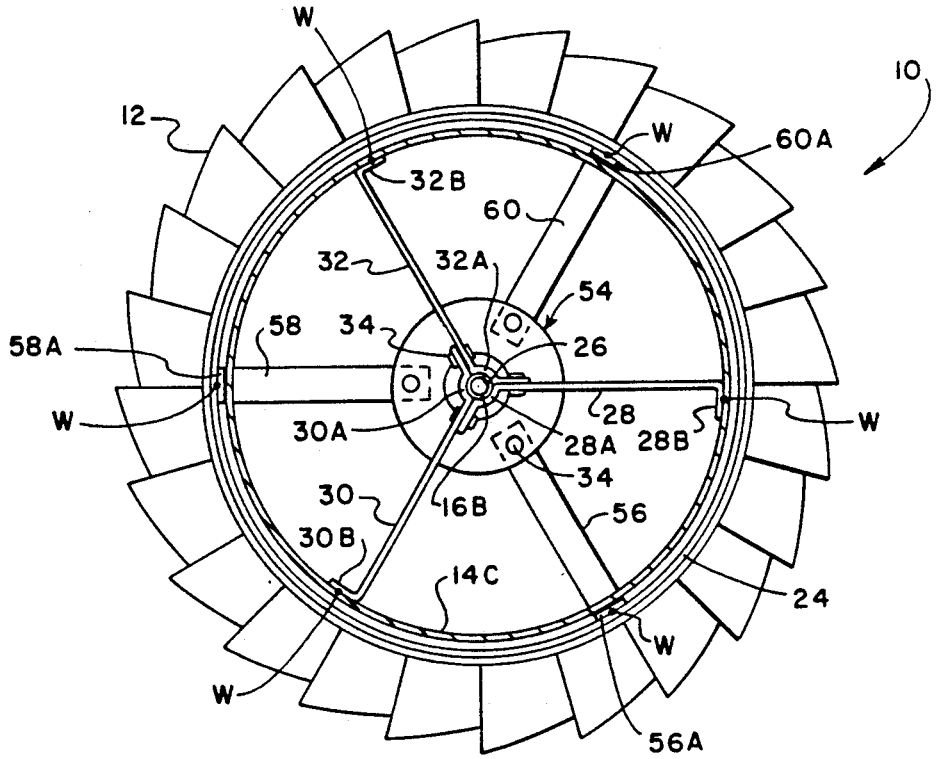
FIG. 2 is a sectional view thereof as seen substantially along the lines 2—2 of FIG. 1.
Figure 3:
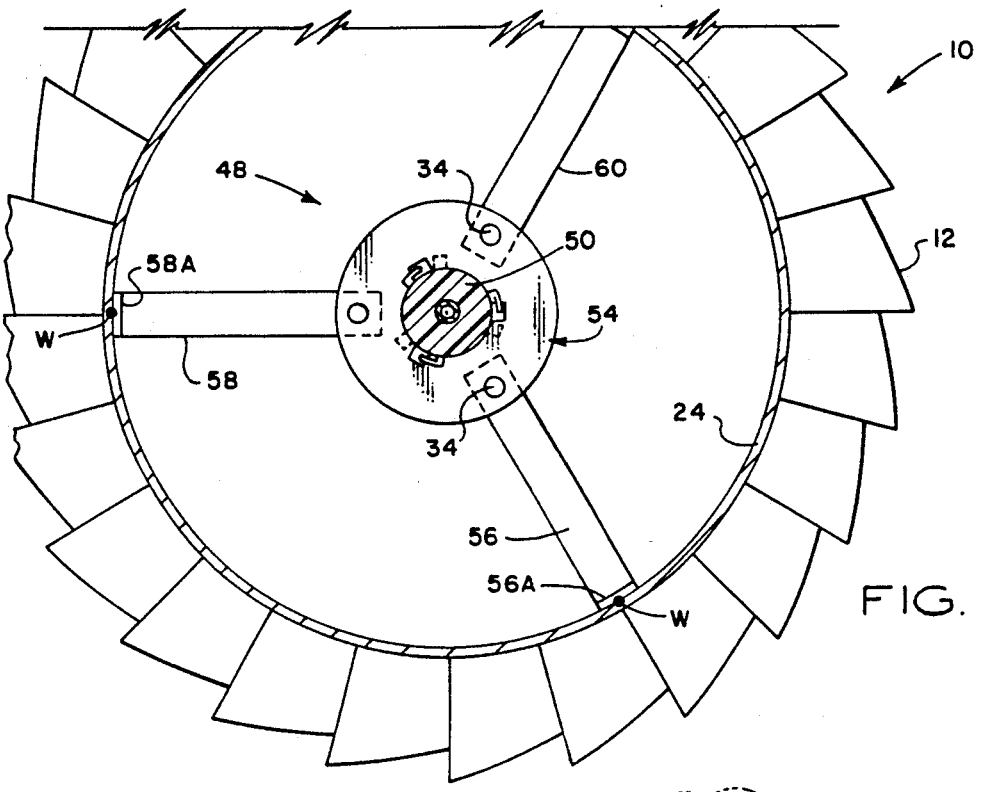
FIG. 3 is a sectional view thereof as seen substantially along the lines 3—3 of FIG. 1.
Figure 4:
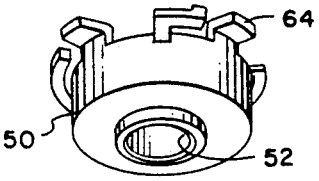
FIG. 4 is a perspective view of the centering collar shown in FIG. 1.
Figure 10:
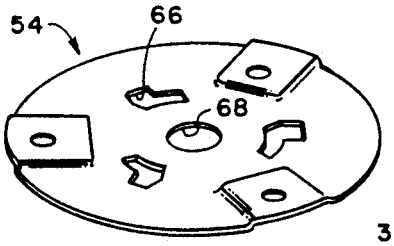
FIG. 10 is a perspective view of the mounting plate shown in FIG. 6.
Figure 5:
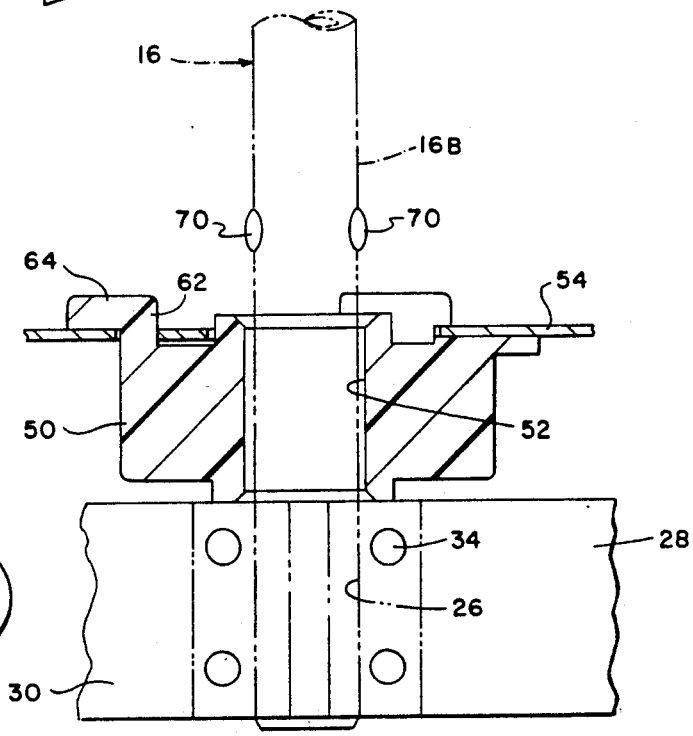
FIG. 5 is a sectional view through the centering collar and base support arms.
Figure 6:
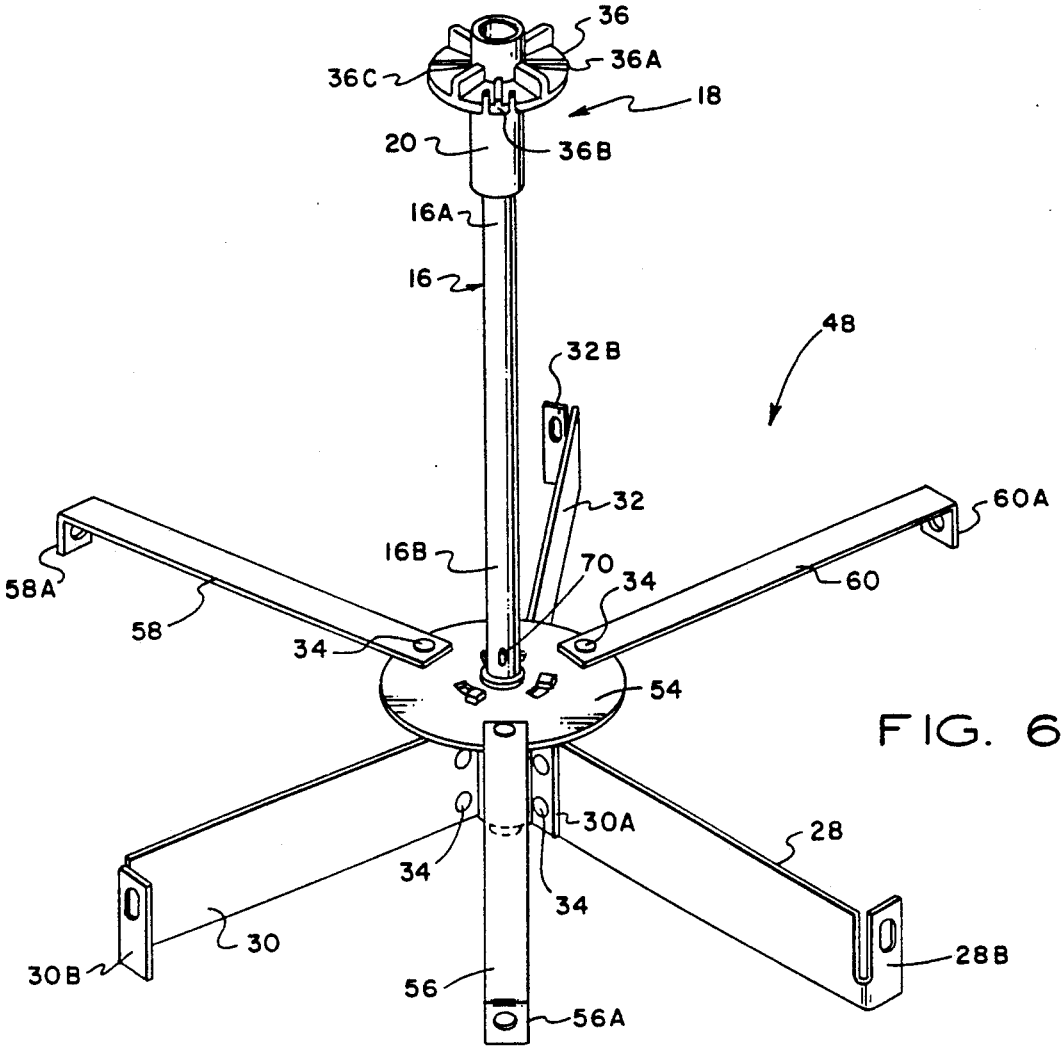
FIG. 6 is a perspective view of the thrust bearing assembly, the spindle and centering collar.
Figure 7:
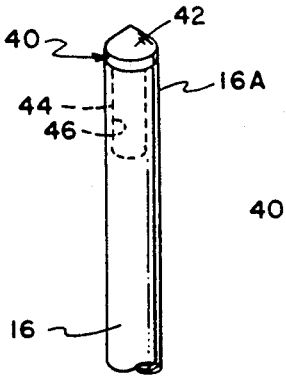
FIG. 7 is a perspective view of the supporting end portion of the spindle.
Figure 8:
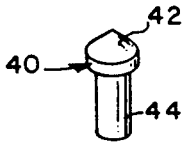
FIG. 8 is the thrust bearing insert shown in FIG. 7.
Figure 9:
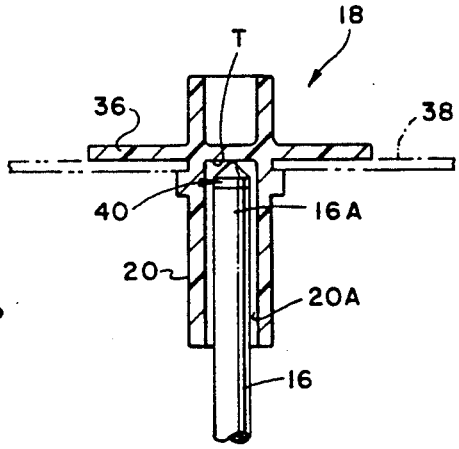
FIG. 9 is a sectional view through the thrust bearing assembly.

Referring now to FIG. 1 and FIG. 2 of the drawings, a turbine ventilator 10 has a vaned turbine rotor head 12 adapted for rotation about an adjustably sectioned tubular base 14 and a coaxial shaft or spindle 16. The turbine head 12 is suspended from a rotatable thrust bearing assembly 18. The thrust bearing 18 includes the upper supporting or insertion end 16A of the spindle 16 and a thrust receptacle 20 for supporting the turbine head 12 for rotation relative to the base 14. The spindle 16 is coaxially disposed within the turbine head 12. The spindle 16 is secured to the base 14 for rotatably supporting the turbine head 12 on the upper supporting end 16A of the spindle 16. The thrust receptacle 20 is secured to the upper portion of the turbine head 12 to receive the thrust end 16A of the spindle 16 and to rotatably support the turbine head 12.

The base 14 includes cylindrical sections 14A, 14B, 14C and a mounting flange 22 extending about its lower end by which it can be secured and flashed over on an apertured roof area. The underside of the turbine head 12 includes an annular collar 24 radially spaced about the upper distal end of the base 14.

For supporting the turbine head for rotation, the support spindle 16 is received in a pocket 26 formed between three guide arms 28, 30 and 32. The lower end 16B of the spindle 16 is received in the pocket 26 and is compressed by the guide arms 28, 30, 32. The guide arms have curved end portions 28A, 30A and 32A joined together by rivet fasteners 34. The guide arms 28, 30 and 32 also include flange portions 28B, 30B and 32B secured to the interior wall 14C of the base 14 by spot welds W.

Referring now particularly to FIGS. 6–9, the thrust bearing assembly 18 has a coupling collar 36 secured to the thrust receptacle 20. The coupling collar 36 is releasably secured to a mounting plate 38 on top of the turbine head 12 by interleaved engagement with deflectable fingers 36A, 36B and 36C. The thrust receptacle 30 has an axial bore which is slightly larger in diameter than the supporting end 16A of the spindle 16 to permit the free rotation of the turbine head 12 about the spindle 16.

The supporting end 16A of the spindle 16 is terminated by a pointed thrust bearing 40. The thrust bearing 40 includes a tapered point 42 and a shaft 44 which is insertable into the tubular spindle end portion 16A. The tapered point 42 engages against a thrust bearing surface T which forms a part of the coupling collar 36.

Preferably, the thrust bearing 40 is fabricated of a friction-reducing material that is complementary to the material composing the thrust receptacle 20. An example of preferred materials which are complementary in the sense that they provide a self-lubricating effect when used together is acetal resin which is sold under the trademark DELRIN by E. I. DuPont de Nemours & Co., and polyamide polymer resin, commonly known as nylon. In the preferred embodiments disclosed herein, the thrust bearing 40 is composed of nylon, and the mating thrust receptacle 20 is composed of acetal resin. The materials may be reversed, with the thrust bearing 40 being constructed of acetal resin, and the thrust receptacle 20 being constructed of nylon.

The nylon material is preferably ZYTEL nylon resin which is available from E. I. DuPont de NeMours & Co. The combination of the DELRIN acetal resin and the ZYTEL nylon resin has been found to give the longest life and the least coefficient of friction. Although the exact operating mechanism is presently unknown, it is believed that the acetal resin and polyamide polymer materials when rubbed against each other produce a molecular interaction and provide a self-lubricating effect which substantially reduces the coefficient of friction.

The thrust bearing 40 is preferably replaceable. For that purpose, the spindle end portion 16A is intersected by an axial bore 46 for receiving the insert shaft 44.

The thrust receptacle 20 is mounted concentrically in alignment with the center of balance of the upper portion of turbine head 12. The thrust bearing 40 and thrust receptacle 20 should cooperate to permit the free rotation of the turbine 12 about the spindle 16.

Referring now to FIGS. 3, 4, 5, 6 and 10, a turbine centering assembly 48 limits lateral movement of the turbine head 12 during its rotation. The centering assembly 48 includes a centering collar 50 secured to the lower portion of the turbine head 12 and rotatably coupled to the lower end 16B of the spindle 16.

Preferably, the centering collar 50 is composed of a friction-reducing material such as DELRIN acetal resin or ZYTEL polyamide polymer resin. The centering collar 50 has a centering bore 52 adapted to freely and loosely engage concentrically about the spindle 16. The centering collar 50 is removable from the turbine head 12 for replacement. In such case the centering collar 50 is releasably secured to a lower mounting plate 54. The mounting plate 54 is secured to the turbine collar 24 by spider arms 56, 58 and 60. Flanges 56A, 58A and 60A are formed extending from spider arms 56, 58 and 60, respectively, for mounting to the turbine collar 24. The flange portions 56A, 58A and 60A are secured to the turbine collar 24 by spot welds W.

The centering collar 50 has projecting arms 62 and locking dogs 64 received within L-slots 66 formed in the lower mounting plate 54. Such means for removably mounting a bearing assembly to a turbine ventilator has been disclosed in U.S. Pat. No. 4,831,921, which is incorporated herein by reference.

The lower mounting plate 54 is intersected by a hole 68 aligned with the centering bore 52 of the centering collar 50 for passage of the spindle 16. Axial displacement of the mounting plate 54 relative to the spindle 16 is limited by the guide arms 28, 30 and 32 and by weld nodes 70.

Figure 11:
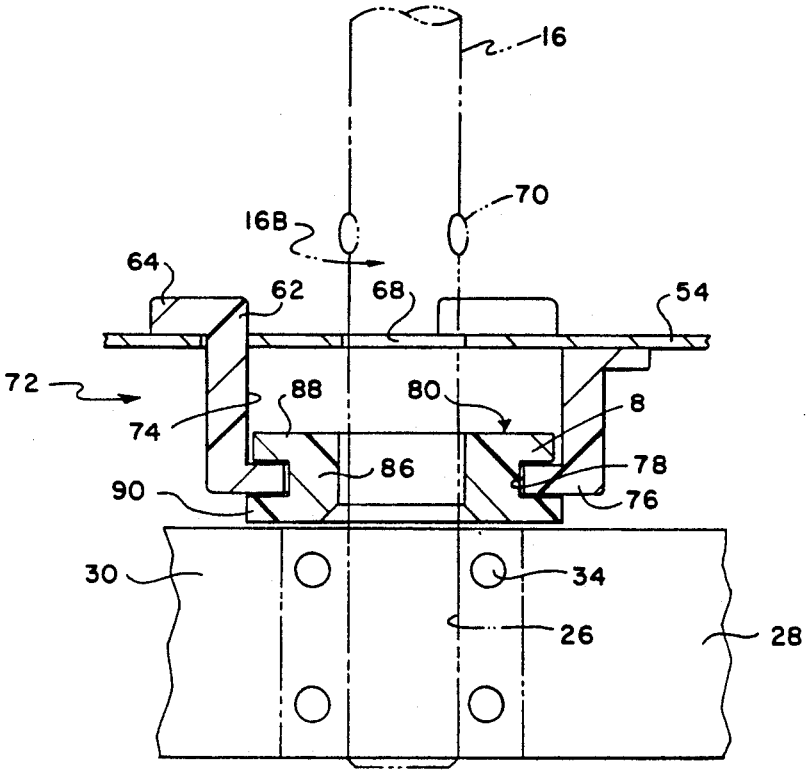
FIG. 11 is a sectional view similar to FIG. 5 showing an alternative centering collar embodiment.
Figure 12:
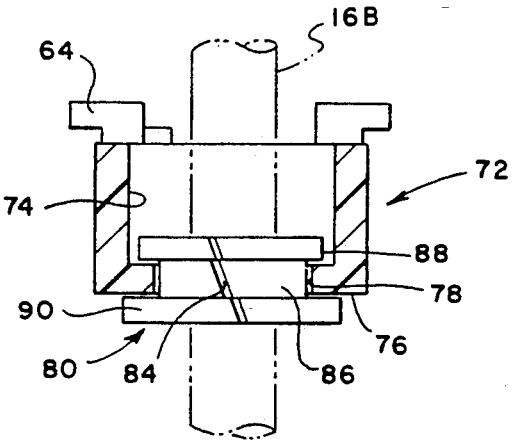
FIG. 12 is an elevational view, partially in section, of the centering collar shown in FIG. 11; and, FIG. 13 is a bottom plan view thereof.
Figure 13:
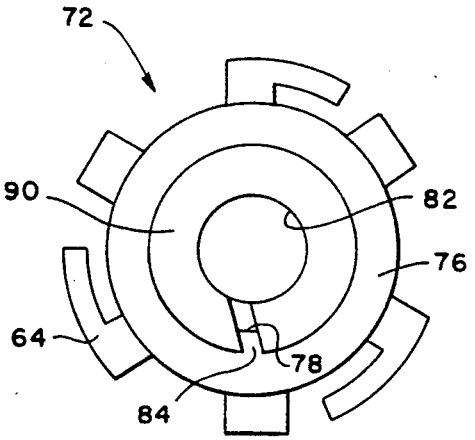

An alternative centering collar arrangement is shown in FIG. 11, FIG. 12 and FIG. 13. In this arrangement, a centering collar 72 is releasably attached to the mounting plate 54 as previously described in connection with the centering collar 50, and is intersected by a bearing pocket 74. The centering collar 72 has a bottom sidewall 76 which is intersected by an axial bore 78. The centering collar 72 is rotatably coupled to the spindle 16 by a bushing 80. The bushing 80 is intersected by an axial bore 82 for receiving the spindle 16, and by a transverse slot 84. The bushing 80 has a cylindrical sidewall portion 86 bounded on opposite ends by annular collars 88, 90, respectively. The cylindrical body portion 86 is received within the bore 78 of the centering collar 72, and axial displacement is limited by the annular collars 88, 90. The bushing 80 is inserted into the centering collar 72 by squeezing the cylindrical body portion 86 together to close the circumferential gap 84, and then inserting the small diameter annular collar portion 88 through the bore 78. After insertion, the body 86 is released, and the bushing 80 is then retained within the bore 78 by the annular end collars 88, 90.

Preferably, the centering collar 72 and the bushing 80 are constructed of friction-reducing materials which provide a self-lubricating effect when used together. In the preferred embodiment, the centering collar 74 is constructed of DELRIN acetal resin, and the bushing 80 is constructed of ZYTEL polyamide polymer resin. It will be appreciated that the self-lubricating effect arises out of frictional engagement between the complementary materials; consequently, the materials may be reversed, with the bushing 80 being constructed of DELRIN acetal resin and the centering collar 72 may be constructed of ZYTEL polyamide polymer resin.

The performance of the ventilator is therefore improved, and the life expectancy of the bearing support is extended considerably as compared to conventional ventilators having journal bearings. Due to the limited load-bearing contact area of the present invention, the turbine ventilator is less susceptible to bearing failure or an increase in friction caused by dust.

While it is anticipated that the bearing assembly of the present invention will last the expected lifetime of the ventilator, the centering sleeve and the shaft receptacle via their connections can nonetheless be removed from their respective mounts for replacement when necessary.

Although the invention has been described with reference to a preferred embodiment, the foregoing description will be understood to be instructional rather than restrictive. It will be appreciated by those skilled in the art that variations may be made in the structure and mode of operation without departing from the spirit and scope of the invention.

What is claimed is:

1. A wind-actuated turbine ventilator comprising, in combination:

a base adapted for surface mounting about an aperture through which a ventilating airflow is to be induced;

a wind-responsive turbine head coupled to said base for rotation about an axis;

thrust bearing means supporting said turbine head for rotation relative to said base, said thrust bearing support means including an elongated axial shaft coaxially disposed within said turbine head in alignment with the rotational axis;

said axial shaft being secured to the base and having an end portion for rotatably supporting the turbine head;

shaft receiving means mounted on the turbine head and receiving the supporting end of the axial shaft;

centering means secured to the turbine head and movably coupled to said shaft for maintaining alignment of the turbine head relative to said shaft and limiting lateral movement of the turbine head relative to the base; said centering means including a collar having a bearing pocket and having a base panel intersected by a bore in communication with said bearing pocket; and, an annular bushing having a cylindrical body portion received within said collar bore and having a first annular shoulder portion received within said bearing pocket, and having a second annular shoulder portion disposed outside of said bearing pocket, said bushing being intersected by an axial bore for receiving said shaft, and being intersected by a transverse slot for permitting circumferential deflection of said body portion.

2. A turbine ventilator assembly as defined in claim 1, wherein said collar and said bushing are constructed of first and second complementary materials, respectively, which exhibit a self-lubricating effect in response to frictional engagement with each other.

3. A turbine ventilator assembly as defined in claim 2, wherein said complementary materials comprise polyamide resin and acetal resin.

4. A turbine ventilator assembly as defined in claim 1, wherein said collar comprises acetal resin and said bushing comprises polyamide resin.

* * * * *